US008433235B2

(12) United States Patent
Hase

(10) Patent No.: US 8,433,235 B2
(45) Date of Patent: Apr. 30, 2013

(54) FIXING DEVICE AND IMAGE FORMING APPARATUS

(75) Inventor: Takamasa Hase, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 322 days.

(21) Appl. No.: 12/985,637

(22) Filed: Jan. 6, 2011

(65) Prior Publication Data

US 2011/0176821 A1 Jul. 21, 2011

(30) Foreign Application Priority Data

Jan. 15, 2010 (JP) ..... 2010-007165

(51) Int. Cl.
*G03G 15/00* (2006.01)

(52) U.S. Cl.
USPC ..... 399/406; 399/45

(58) Field of Classification Search ..... 399/406, 399/45, 68, 67
See application file for complete search history.

(56) References Cited

U.S. PATENT DOCUMENTS

| | | | | |
|---|---|---|---|---|
| 5,270,778 | A * | 12/1993 | Wyer | 399/406 |
| 7,298,981 | B2 | 11/2007 | Oohara et al. | |
| 7,664,415 | B2 | 2/2010 | Mikutsu | |
| 8,009,998 | B2 * | 8/2011 | Kajita | |
| 2006/0245795 | A1 * | 11/2006 | Kamiyama | |
| 2009/0148205 | A1 | 6/2009 | Seo et al. | |
| 2009/0245897 | A1 | 10/2009 | Seo et al. | |
| 2009/0297197 | A1 | 12/2009 | Hase | |
| 2010/0061753 | A1 | 3/2010 | Hase | |
| 2011/0044734 | A1 | 2/2011 | Shimokawa et al. | |

FOREIGN PATENT DOCUMENTS

| | | |
|---|---|---|
| JP | 2001-154525 | 6/2001 |
| JP | 2006-23427 | 1/2006 |
| JP | 2007-212526 | 8/2007 |
| JP | 2008-139817 | 6/2008 |
| JP | 2008-175908 | 7/2008 |
| JP | 2009-14829 | 1/2009 |

OTHER PUBLICATIONS

U.S. Appl. No. 12/946,347, filed Nov. 15, 2010, Ishii, et al.
U.S. Appl. No. 13/009,199, filed Jan. 19, 2011, Yamaguchi, et al.
U.S. Appl. No. 12/923,272, filed Sep. 13, 2010, Takahiro Imada.
U.S. Appl. No. 12/881,862, filed Sep. 14, 2010, Takamasa Hase, et al.
U.S. Appl. No. 12/861,255, filed Aug. 23, 2010, Satoshi Ueno, et al.

* cited by examiner

*Primary Examiner* — Susan Lee
(74) *Attorney, Agent, or Firm* — Oblon, Spivak, McClelland, Maier & Neustadt, L.L.P.

(57) ABSTRACT

A fixing device, in which an unfixed image carried by a recording medium is passed through a fixing nip part being pressed by a fixing rotative body and a pressuring rotative body, and is fixed to the recording medium, is disclosed, including: a pressing part, and control part. The pressing part applies a pressure to the fixing nip part. The control part controls the pressure to be applied to the fixing nip part by the pressing part, to be lower than a case in which the recording medium passes through a curl correcting part for correcting a curl of the recording medium, when the recording medium does not pass through the curl correcting part.

15 Claims, 9 Drawing Sheets

FIG.9

| | WITH DECURL ROLLER | | WITHOUT DECURL ROLLER | |
|---|---|---|---|---|
| PRESSING LEVEL | THICKNESS OF PAPER SHEET | PRINT MODE | THICKNESS OF PAPER SHEET | PRINT MODE |
| FIRST PRESSING STATE | | COLOR PRINT, HIGH SPEED PRINT, MEDIUM LUSTER PRINT | THIN PAPER SHEET | BLACK AND WHITE PRINT, LOW SPEED PRINT, EXCELLENT LUSTER PRINT |
| SECOND PRESSING STATE | THIN PAPER SHEET | | REGULAR PAPER SHEET, THICK PAPER SHEET | |
| THIRD PRESSING STATE | REGULAR PAPER SHEET, THICK PAPER SHEET | | | |

FIXING DEVICE AND IMAGE FORMING APPARATUS

BACKGROUND OF THE INVENTION

1. Field of the Invention

The present invention is related to a fixing device and an image forming apparatus, and in particular to, the fixing device which fixes an unfixed image onto a recording medium, and the image forming apparatus such as a copier, a facsimile, a printer, a printing machine, and the like including the fixing device.

2. Description of the Related Art

Conventionally, in an image forming apparatus such as a copier, a facsimile, a printer, and a printing machine, or the like, a copied material or a printed material is generated by heating and fixing an unfixed image which is transferred and is supported on a recording medium.

In a heating and fixing process, by a fixing roller and a fixing nip part formed by a pressure roller pressing and contacting the fixing roller, the recording medium supporting the unfixed image is clamped and heated. By this process, a developer for forming the unfixed image such as a toner is melted and softened. When the developer is infiltrated into the recording medium, the unfixed image is fixed on the recording medium.

In the fixing device, as the recording medium on which an image is fixed, various recording media such as a thin paper, a regular paper, a thick paper, and the like are used. If a constant pressure and heat are applied at the fixing nip part, a fixing performance is not sufficiently stabilized. Japanese Laid-open Patent Application No. 2009-14829 discloses a fixing apparatus in that a position of a pressing member is changed with respect to the a fixing member for pressing and heating.

The fixing apparatus disclosed in Japanese Laid-open Patent Application No. 2009-14829 sets a preferred pressure at the fixing nip part depending on a type of a recording medium being conveyed. As a result, it is possible to prevent an occurrence of a wrinkle to the recording medium and from an insufficient fixing or an excess fixing of toner transferred on the recording medium. Thus, the fixing performance of the toner transferred on the recording medium is improved at the fixing nip part of the fixing device.

In the image forming apparatus including the fixing roller, in order to improve a separation between the recording medium and the fixing roller when the recording medium is passing through the fixing nip part, a curvature of the fixing nip part is set to be a large value. However, there is a problem in that the recording medium passing through the fixing nip part is ejected in a curled state.

In order to solve this problem, Japanese Laid-open Patent Application No. 2006-23427 discloses an image forming apparatus including a correction nip part formed by a pair of decurl rollers having a curvature in an opposite direction to the fixing nip part.

The image forming apparatus disclosed in Japanese Laid-open Patent Application No. 2006-23427 includes a fixing nip part which heats and fixes the unfixed image onto the recording medium, and a decurl mechanism which is formed by a correction nip part for correcting a curl of the recording medium formed when the recording medium passes through the fixing nip part and a guide which is arranged at a downward side of conveying the recording medium at the correction nip part and adjusts a conveying direction of the recording medium passing through the correction nip part. Accordingly, the conveying direction of the recording medium is changed by the guide while passing through the correction nip part, and the curl of the recording medium is corrected.

Moreover, in general, a convey path of the recording medium rises perpendicularly at the fixing nip part from a bottom part of the image forming apparatus, and goes toward one of paper ejecting ports. Thus, if it is attempted to correct all curls of the recording medium, the decurl mechanism is required to be arranged immediately after the fixing nip part or to be arranged at each of the paper ejecting ports.

However, if the decurl mechanism is arranged immediately after the fixing nip part, a space is required in a longitudinal direction. As a result, a main body of the image forming apparatus becomes a larger size. Instead, if the decurl mechanism is arranged at each of the paper ejecting ports, the image forming apparatus becomes the larger size as a whole and expense is increased. Thus, the decurl mechanism is arranged at a regular paper ejecting port alone which is frequently used. In a case of ejecting a paper sheet from any one of paper ejecting ports other than the regular paper ejecting port, the recording medium is curled and a jam may be caused.

SUMMARY OF THE INVENTION

The present invention solves or reduces one or more of the above problems.

In an aspect of this disclosure, there is provided a fixing device including: a fixing rotative body; a pressuring rotative body configured to form a fixing nip part between the pressuring rotative body and the fixing rotative body by contacting the fixing rotative body; a heating part configured to heat at least one of the fixing rotative body and the pressuring rotative body; a pressing part configured to apply a pressure to the fixing nip part; and a control part configured to control the pressure to be applied to the fixing nip part by the pressing part, to be lower than a case in which a recording medium passes through a curl correcting part for correcting a curl of the recording medium, when the recording medium does not pass through the curl correcting part, wherein an unfixed image carried by the recording medium is passed through the fixing nip part being pressed by the fixing rotative body and the pressuring rotative body, and is fixed to the recording medium.

In another aspect of this disclosure, there is provided an image forming apparatus having a fixing device including: a fixing rotative body; a pressuring rotative body configured to form a fixing nip part between the pressuring rotative body and the fixing rotative body by contacting the fixing rotative body; a heating part configured to heat at least one of the fixing rotative body and the pressuring rotative body; a pressing part configured to apply a pressure to the fixing nip part; and a control part configured to control the pressure to be applied to the fixing nip part by the pressing part, to be lower than a case in which a recording medium passes through a curl correcting part for correcting a curl of the recording medium, when the recording medium does not pass through the curl correcting part, wherein an unfixed image carried by the recording medium is passed through the fixing nip part being pressed by the fixing rotative body and the pressuring rotative body, and is fixed to the recording medium.

BRIEF DESCRIPTION OF THE DRAWINGS

In the following, embodiments of the present invention will be described with reference to the accompanying drawings.

FIG. 9 is a diagram illustrating a correspondence table for a pressing level to be selected based on a print mode and a thickness of a print sheet.

DESCRIPTION OF THE PREFERRED EMBODIMENT

[First Embodiment]

In the following, a first embodiment according to the present invention will be described with reference to the accompanying drawings.

First, a configuration according to the first embodiment will be described.

Figure 1:
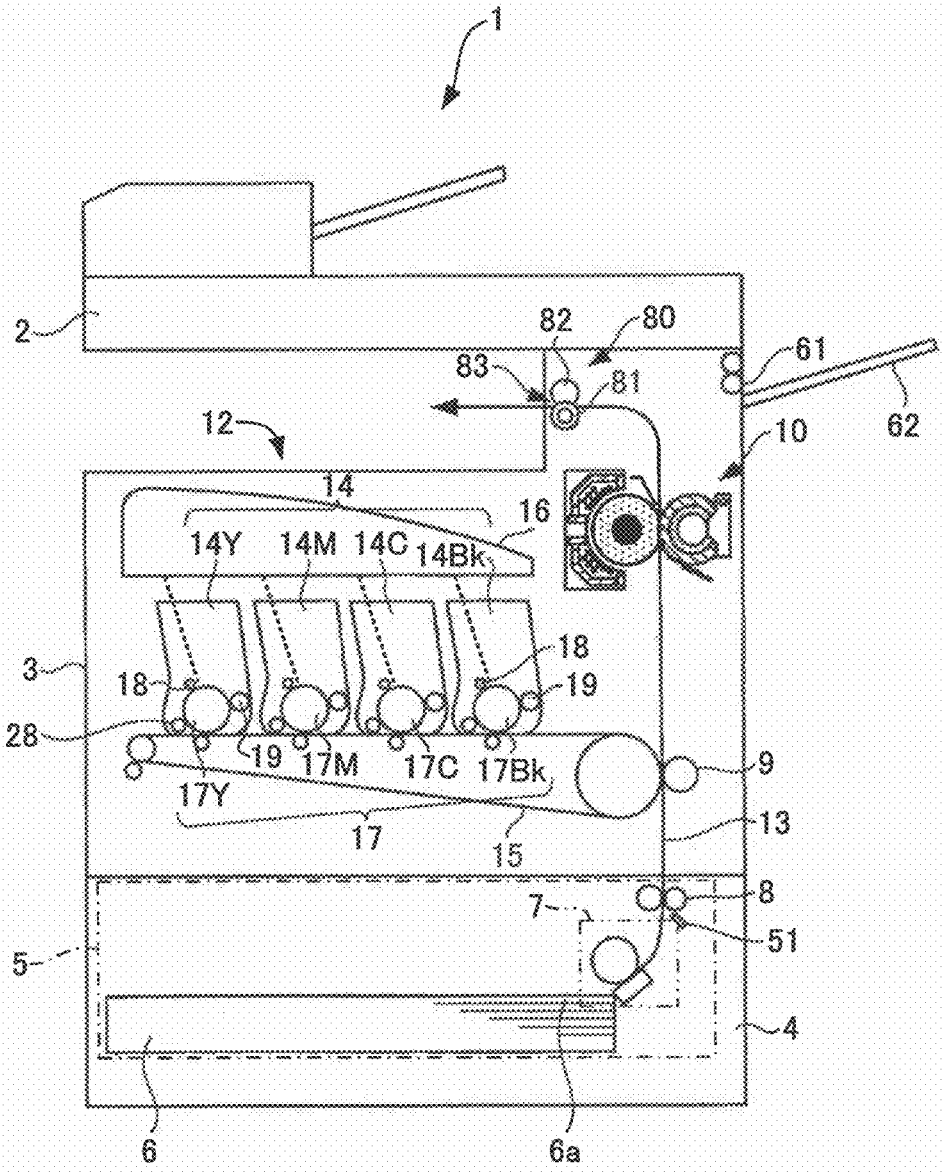
FIG. 1 is a schematic diagram illustrating an image forming apparatus according to a first embodiment of the present invention.

As shown in FIG. 1, an image forming apparatus 1 includes a scan part 2 for scanning an image on an original sheet, a feeding part 4 for feeding a sheet member 6*a* as a recording medium which is the most top sheet on multiple sheet members 6*a* being stacked, and an image forming part 3 for forming the image which is scanned by the scan part 2 with respect to the sheet member 6 fed by the feeding part 4, a fixing device 10 for fixing an unfixed image which is formed on the sheet member 6*a* by the image forming part 3, and a decurl mechanism 80 for correcting a curl of the sheet member 6*a*. In the image forming apparatus 1 according to the first embodiment, the image forming part 3 and the feeding part 4 can be separated.

The image forming part 3 includes four imaging parts 14 (14Y for yellow, 14C for cyan, 14M for magenta, and 14Bk for black), an intermediate transfer belt 15, and an exposure device 16.

The imaging part 14Y includes a photoreceptor 17Y for yellow which is rotated and driven in a clockwise rotation and functions as an image carrier, a charging part 18, a developing part 19, a cleaning part 28, and the like. The charging parts 18, the developing parts 19, and the cleaning parts 28 is arranged around the photoreceptors 17Y. Similarly, the imaging parts 14C, 14M, and 14Bk include photoreceptors 17C for cyan, 17M for magenta, and 17Bk for black, respectively. Each of the imaging parts 14C, 14M, and 14Bk includes the charging parts 18, the developing parts 19, and the cleaning parts 28 which are arranged around the photoreceptors 17C, 17M, and 17Bk, respectively. The photoreceptors 17Y, 17C, 17M, and 17Bk are collectively called photoreceptors 17. Each of the imaging parts 14Y, 14C, 14M, and 14Bk forms an image of a respective color by using toner, that is, a toner image T (shown in FIG. 2).

Each of the photoreceptors 17 is formed to be a cylindrical shape, and is rotated and driven by a drive source (not shown). In each of the photoreceptors 17, a photosensitive layer is applied on an outer surface. By emitting a light beam (indicated by dashed lines) from the exposure device 16 on the outer surface of each of the photoreceptors 17, an electrostatic latent image is formed on the outer surface of each of the photoreceptors 17 in accordance with image information.

The charging part 18 uniformly charges the outer surface of the photoreceptor 17Y. A contact charging system is applied to the charging part 18 to charge the photoreceptor 17Y by a contact. The developing part 19 supplies toner to the photoreceptor 17Y, the supplied toner is adhered to the electrostatic latent image formed on the outer surface of the photoreceptor 17Y so that the electrostatic latent image becomes visible as the toner image. A non-contact charging system, which adheres toner to the photoreceptor 17Y without a contact, is applied to the developing part 19.

The cleaning part 28 removes residual toner being adhered on the outer surface of the photoreceptor 17Y. A brush contact system, which contacts a brush to the outer surface of the photoreceptor 17Y, is applied to the cleaning part 28. The above-described manner is conducted to each of the photoreceptors 17M, 17C, and 17Bk.

The intermediate transfer belt 15 is formed by an endless belt which is made of a resin film or a rubber as a substrate. The toner image formed on the photoreceptor 17 is transferred to the intermediate transfer belt 15. The toner image transferred to the intermediate transfer belt 15 is further transferred as an unfixed image to the sheet member 6*a* by a transfer roller 9.

The exposure device 16 converts image data being input from a terminal such as a personal computer, a word processor, and the like which is connected through a network, and data representing an image of an original sheet scanned by the scan part 2, into a signal for driving a light source. The exposure device 16 drives a semiconductor laser in each of laser source units based on this converted signal to emit the light beam.

The feeding part 4 includes a feeding unit 5 as a unit for separately feeding each sheet member. The feeding unit 5 includes a separation part 7 for sticking the sheet member 6*a* from the top of the multiple sheet members 6 being stacked in a paper feed tray, and for feeding the sheet member 6*a* to a downstream side of a conveying direction.

The sheet member 6*a* separated and fed by the feeding unit 5 is conveyed into a conveyance path 13. The sheet member 6*a* conveyed to the conveyance path 13 is further conveyed by a pair of conveying rollers 8. By the transfer roller 9, the toner image T formed by the image forming part 3 is transferred to the sheet member 6*a* conveyed by the pair of conveying rollers 8.

The fixing device 10 fixes the toner image T transferred to the sheet member 6*a* by the transfer roller 9, by using a fixing nip part 27 (illustrated in FIG. 2) which will be described later. The fixing device 10 will be described later in detail.

The decurl mechanism 80 includes an elastic roller 81, and a heat roller 82. In the first embodiment, the decurl mechanism 80 is formed as a curl correction part.

The elastic roller 81 and the heat roller 82 form a correction nip part 83. A curvature of the correction nip part 82 is formed in an opposite direction to a curvature of the fixing nip part 27 with respect to the sheet member 6*a*.

The elastic roller 81 is driven by a roller motor 71 (FIG. 6) which will be described. In detail, when the roller motor 71 is driven by a main body control part 100 (FIG. 6) which will be described, a gear fixed to an output shaft of the roller motor 71 is rotated. By this rotation of the gear, the gear of the roller motor 71 is engaged with a gear fixed to a rotating shaft of the elastic roller 81, so as to rotate the elastic roller 81. The heat roller 82 follows rotation of the elastic roller 81.

Also, the image forming apparatus 1 includes an ejection tray 12 and a FAX tray 62. The sheet member 6*a*, on which an image scanned from the original sheet by the scan part 2 or an image representing image data received from the terminal through the network is fixed by the fixing device 10, is conveyed by the decurl mechanism 80 and a pair of rollers (not shown), and is ejected to the ejection tray 12. Also, the sheet member 6*a*, on which an image received by a facsimile through a telephone line is fixed by the fixing device 10, is conveyed by the pair of paper ejection rollers, and is ejected to the FAX tray 62.

For example, the image forming apparatus 1 may be a copier, a facsimile, a printing machine, or a multi-functional apparatus.

Figure 2:
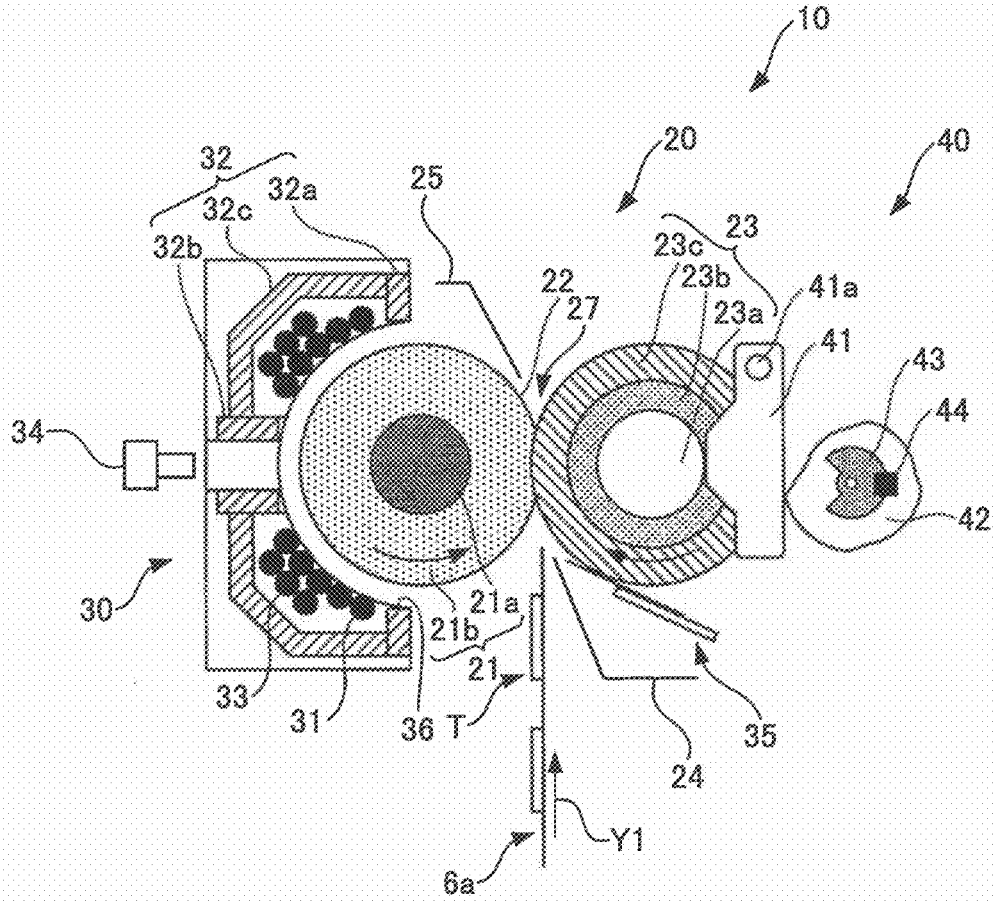
FIG. 2 is a schematic diagram illustrating a fixing device according to the first embodiment of the present invention.

As illustrated in FIG. 2, the fixing device 10 includes a fixing part 20 for fixing the toner image T to the sheet member 6*a*, an induction heating part 30 for applying induction heating to the fixing part 20 by generating magnetic flux, and a pressuring part 40 for applying pressure to the fixing part 20.

The fixing part 20 includes a fixing roller 21 as a support member, a fixing sleeve 22 which is formed at periphery of the fixing roller 21 and is heated by the induction heating part 30, and a pressure roller 23 brought into pressure contact with the fixing roller 21.

Figure 3:
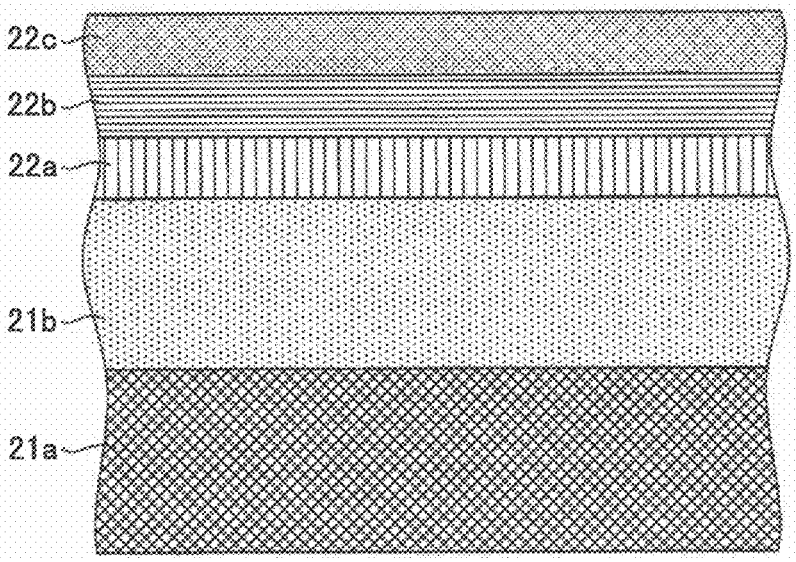
FIG. 3 is a cross-sectional view illustrating an enlarged portion of a fixing roller or a fixing sleeve which is cut in a radial direction of the present invention.

As illustrated in FIG. 3, the fixing roller 21 is formed by layering an elastic layer 21*b* being thermostable on a metal core 21*a* being a cylindrical shape, and has an external diameter of 40 mm. Also, the fixing roller 21 maintains the fixing sleeve 22 being thin in a roller shape, by contacting with an inside surface of the fixing sleeve 22.

The metal core 21*a* is formed of a metal member such as stainless steel or the like. The elastic layer 21*b* is formed by a heat-resistant and elastic member made of silicone foam. Also, the elastic layer 22*b* is formed to be 9 mm in radial thickness and 30° through 50° in the Asker C hardness in a radial direction, that is, on the shaft.

The fixing sleeve 22 is formed by sequentially layering the elastic layer 22*b* and a release layer 22*c* on a metallic substrate 22*a*, and has an external diameter of 40 mm. In the first embodiment, the fixing roller 21 and the fixing sleeve 22 are formed as a fixing rotative body.

The substrate 22*a* is formed by a magnetic metal material such as ferrum, cobalt, nickel, an alloy thereof, or the like, and is 30 μm through 50 μm in thickness. Also, the substrate 22*a* is made to generate heat by electromagnetic induction. That is, in the first embodiment, the substrate 22*a* is made as a heat generation layer.

The elastic layer 22*b* is formed by an elastic member having 150 μm in thickness. A silicone rubber, a fluoro silicone rubber, and the like are used as the elastic member. In a viewpoint of heat resistance and hardness, the silicone rubber is preferred. By layering the elastic layer 22 on the substrate 22*a*, it is possible to prevent the fixing sleeve 22 from having a greater heat capacity, and to fix a preferred image on the sheet member 6*a* without a fixing irregularity.

The release layer 22*c* is formed by being coated with a fluorine compound in a tubular shape, and is 50 μm in thickness. The release layer 22*c* is formed to improve toner releasability of a surface of the fixing sleeve 22 with which the toner image T is directly contacted. Also, as the fluorine compound, PTFE (polytetrafluoroethylene), PFA (perfluoroalk-oxy), FEP (Fluorinated ethylene propylene), and a mixture thereof can be used. In a viewpoint from hardness and smoothness, PFA is preferred.

Referring back to FIG. 2, the pressure roller 23 is formed by a metal core 23*a*, an elastic layer 23*b*, and a release layer 23*c*. The elastic layer 23*b* and the release layer 23*c* are sequentially layered on the pressure roller 23. The pressure roller 23 has an external diameter of 40 mm. In the first embodiment, the pressure roller 23 is formed as a pressuring rotative body.

The metal core 23*a* is formed by metal having high thermal conductivity such as aluminum, copper, and the like. The elastic layer 23*b* is formed by an elastic material having heat resistance such as silicone rubber or the like, and is 2 mm in thickness. Also, the release layer 23*c* is formed by a fluorine compound such as PFA or the like in the tubular shape, and is 50 μm in thickness.

The pressure roller 23 is brought into pressure contact with the fixing roller 21 via the fixing sleeve 22 by a pressure lever 41 which will be described later. That is, the fixing nip part 27 is formed by the fixing roller 21 and the pressure roller 23 at a pressure contact portion.

The induction heating part 30 is arranged to face to the outer surface of the fixing roller 21, and includes an exciting coil 31, a core part 32, a demagnetization coil 33, and a coil guide 36. Also, the induction heating part 30 causes the substrate 22*a* of the fixing sleeve 22 to generate heat by the electromagnetic induction, by generating magnetic flux. Moreover, in a casein that a pressure of the fixing nip part 27 is controlled by the main body control part 100 to be weakened, the induction heating part 30 is made to generate a heating amount more than a case in which the pressure of the fixing nip part 27 is not controlled to be weakened. That is, in the first embodiment, the induction heating part 30 is formed as a heating part.

The exciting coil 31 is extended and arranged in a width direction (a perpendicular direction to the sheet member 6*a* in FIG. 2) so that its wire, which ties thin lines, is wound on the coil guide 36 which is arranged to cover a part of the outer surface of the fixing sleeve 22.

The core part 32 is formed by a ferromagnetic having a high electric resistivity such as ferrite, permalloy, and the like, and is arranged so as to face to the exciting coil 31 being extended in the width direction. In the first embodiment, the core part 32 is formed by ferrite having approximately a relative permeability of 2500.

Also, for each core part 32, a side core 32*a*, a center core 32*b*, and an arch core 32*c* are formed to make a magnetic flux effectively reach the fixing sleeve 22 and make the fixing sleeve 22 effectively generate heat.

The center core 32*b* is positioned in a vicinity of the outer surface of the fixing sleeve 22 and in a vicinity of a horizontal surface including a center shaft of the fixing roller 21 and a center shaft of the pressure roller 23. Also, the side core 32*a* is positioned in a vicinity of the outer surface of the fixing sleeve 22 and a vicinity of a perpendicular surface being orthogonal to the horizontal surface and including the center shaft of the fixing roller 21. Moreover, the arch core 32*c* is connected to the side core 32*a* and the center core 32*b*.

The demagnetization coil 33 is arranged in being symmetrical to a position relationship corresponding to a width direction of the recording medium, and is overlaid and arranged on the exciting coil 31.

The coil guide 36 is formed by a resin material or the like having high heat resistance, and is made to hold the exciting coil 31.

By this configuration, the magnetic flux generated by the induction heating part 30 affects the fixing sleeve 22 and induces the fixing sleeve 22 to generate heat.

Figure 6:
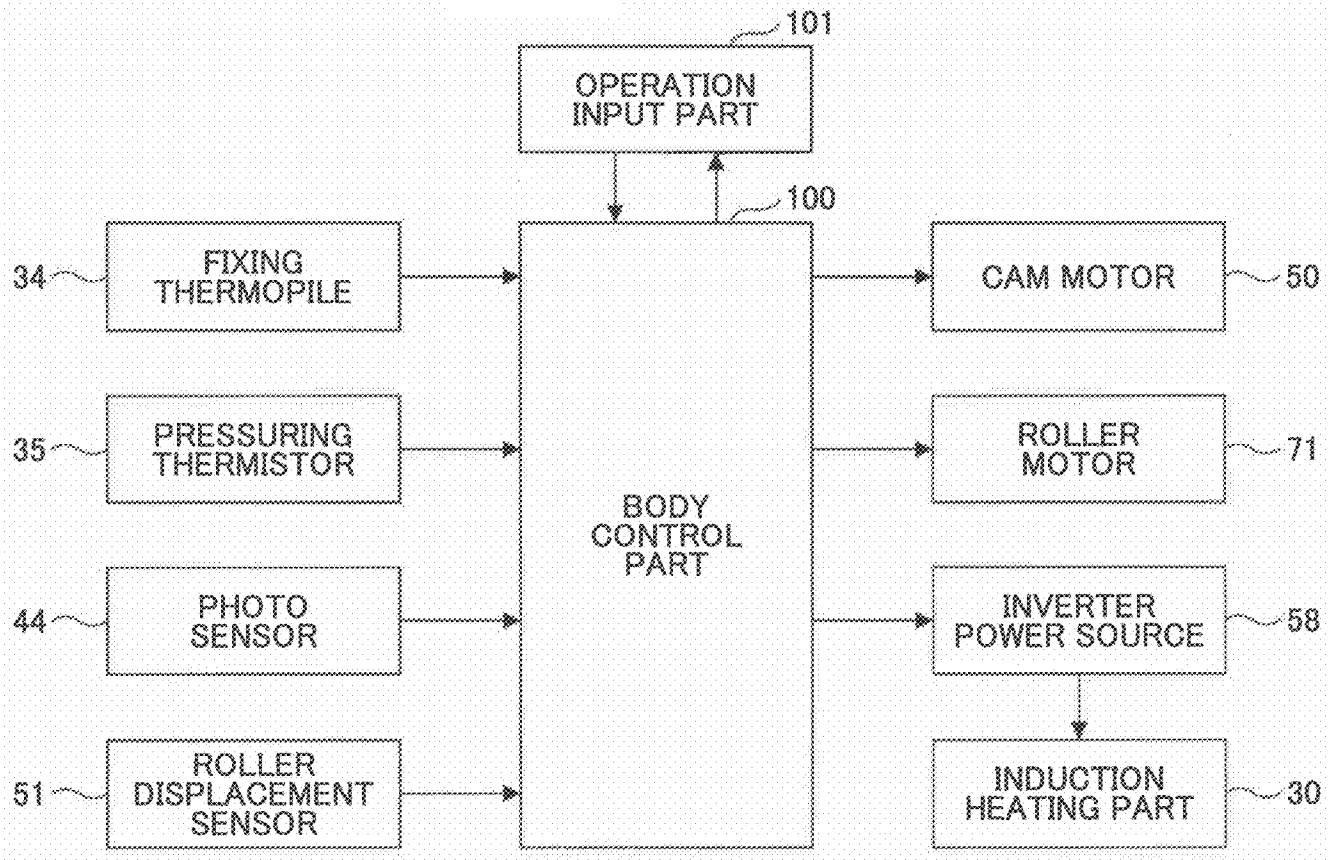
FIG. 6 is a diagram illustrating a main body control part according to the first embodiment of the present invention.

The exciting coil 31 is connected to an inverter power source 58 (FIG. 6). The inverter power source 58 supplies 10 kHz through 1 MHz. Preferably, the inverter power source 58 supplies 20 kHz through 800 MHz of a high frequency alternating current.

The fixing device 10 further includes an entry guide plate 24 for guiding the sheet member 6*a* to the fixing nip part 27, and a separation plate 25 for firmly separating the sheet member 6*a* passing through the fixing nip part 27 from the fixing sleeve 22.

The fixing device 10 further includes a fixing thermopile 34 for measuring temperature of the fixing sleeve 22, that is, fixing temperature. The fixing thermopile 34 is arranged to face to a surface of the fixing sleeve 22 without contact via a through hole formed on the coil guide 36, so that the fixing thermopile 34 is not influenced by the induction heating.

By this arrangement of the fixing thermopile 34, in the fixing device 10, the fixing thermopile 34 and the main body control part 100 are wired from an outside of the coil guide 36. It should be noted that the fixing thermopile 34 may be partially or entirely fitted in the through hole formed on the coil guide 36.

A signal indicating the fixing temperature measured by the fixing thermopile 34 is sent to the main body control part 100. The main body control part 100 is made to adjust the magnetic flux generated from the induction heating part 30 based on a measurement result of the fixing thermopile 34 and a signal input form each of various sensors, and to control temperature of the fixing roller 21.

The pressuring part 40 includes a pressure lever 41, a cam 42, a filler 43, and a photosensor 44. Also, the pressuring part 40 applies pressure to the fixing nip part 27. That is, in the first embodiment, the pressuring part 40 is formed as a pressuring part.

The pressure lever 41 is made to be turnable with a focus on a center shaft 41*a* of one end, and another end is made to be pressed to the cam 42. In addition, the pressure lever 41 is made to press a shaft portion of the pressure roller 23 with a lateral surface at an opposite side to a lateral surface being pressed by the cam 42, between the another end being pressed by the cam 42 and the center shaft 41*a*.

Figure 4:
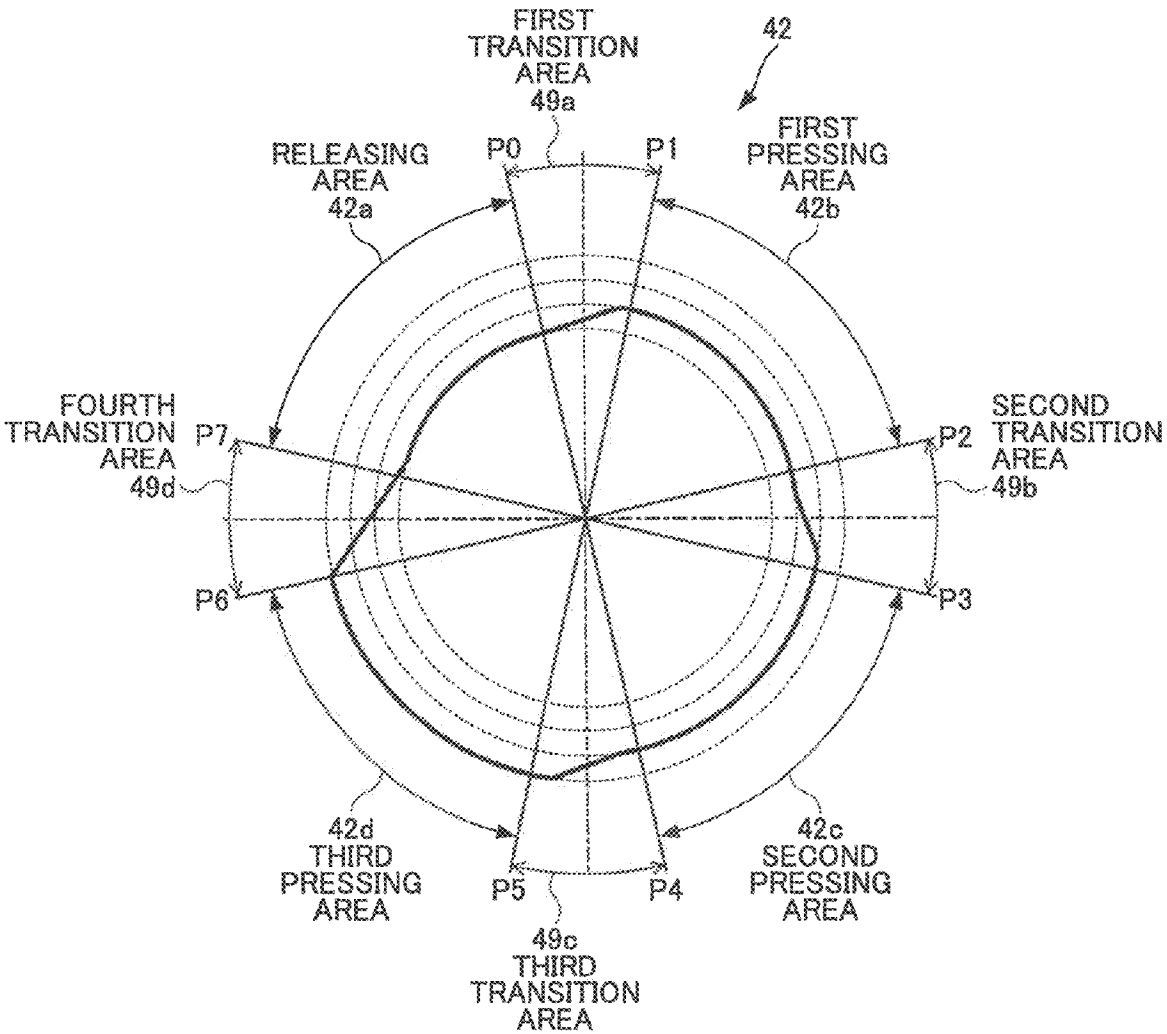
FIG. 4 is a schematic cross-sectional view illustrating a cam according to the first embodiment of the present invention.
Figure 5A:
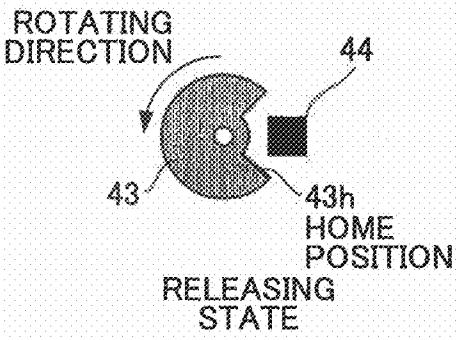
FIG. 5A through FIG. 5D are schematic diagrams illustrating pressing states of the cam according to the first embodiment of the present invention.
Figure 5B:
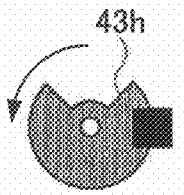
Figure 5C:
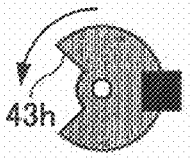
Figure 5D:
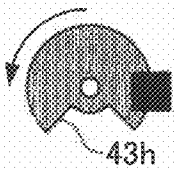

As illustrated in FIG. 4, four areas having a different external diameter, and four transition areas for smoothly transiting between theses areas are formed on the cam 42. Moreover, the cam 42 is made to rotate in a counter clockwise rotation alone in FIG. 4. The cam 42 causes the pressure roller 23 to press and contact the fixing roller 21 through the pressure lever 41, depending on each of the above-described areas. However, the cam 42 includes statary sections corresponding to pressuring steps and curve sections for switching a pressure power.

In detail, on the cam 42, a releasing area is formed to have the smallest external diameter between a position P7 and a position P0, a first pressing area 42*b* is formed to have a second smaller external diameter between a position P1 and a position P2, a second pressing area 42*c* is formed to have a third smaller external diameter between a position P3 and a position P4, and a third pressing area 42*d* is formed to have the largest external diameter between a position P5 and a position P6. Moreover, on the cam 42, a first transition area 49*a* is formed to transit from the releasing area to the first pressing area 42*b* between the position P0 and the position P1, a second transition area 49*b* is formed from the first pressing area 42*b* to the second pressing area 42*c* between the position P2 and the position P3, a third transition area 49*c* is formed from the second pressing area 42*c* to the third pressing area 42*d* between the position P4 and the position P5, and a fourth transition area 49*d* is formed from the third pressing area 42*d* to the releasing area 42*a* between position P6 to the position P7.

Accordingly, by changing a rotation position of the cam 42, a pressing power of the pressing roller 23 with respect to the fixing roller 21 is changed. That is, by rotating the cam 42 by a driving part (not shown), the pressure lever 41 is driven in a horizontal direction, and the pressing power of the pressing roller 23 is varied with respect to the fixing roller 21. For example, the driving part may be formed by a spindle motor and a reduction gear.

The filler 43 is attached to the shaft supporting the cam 42, and is rotated in association with the cam 42. As illustrated in FIG. 5A through FIG. 5D, the filler 43 has a disk shape in which a ¼ circle is cut off.

The photosensor 44 is arranged so as to clip the filler 43. The photosensor 44 detects one state in which a sensing light is shielded by the filler 43, that is, a shielded state to be high. Also, the photosensor 44 detects another state in which a sensing light is not shielded by the filler 43, that is, an unshielded state to be low. The photosensor 44 detects the rotation position of the cam 42 by counting pulses of a stepping motor from a time of transiting from a low detection to a high detection. A position of transiting from the low detection to the high detection, that is, an edge portion of the filler 43 is defined to be a home position 43*h*. Moreover, the photosensor 44 can detect a transition from the high detection to the low detection.

A control for the fixing nip part 27 to transit to each of a first pressing state, a second pressing state, a third pressing state, and a releasing state will be described. Moreover, at a startup and at each transition of the above-described states, the home position 43*h* is always detected and then, the transition is performed.

First, at the start up of the image forming apparatus 1, the main body control part 100 activates a cam motor 50 being the spindle motor, rotates the cam 42, and detects the home position 43*h* of the filler 43 by the photosensor 44.

In a case of transiting to the third pressing state (FIG. 5D), after the home position 43*h* of the filler 43 is detected, the cam 42 is rotated by ⅝ rotation until a position of the third pressing state, by counting the pulses of the cam motor 50. Moreover, in a case of transiting to the second pressing state (FIG. 5C), after the home position 43*h* of the filler 43 is detected, the cam 42 is rotated by ⅜ rotation until a position of the second pressing state, similar to the case of transiting to the third pressing state.

In a case of transiting to the first pressing state (FIG. 5B), after the home position 43*h* of the filler 43 is detected, the cam 42 is rotated by ⅛ rotation until a position of the first pressing state, similar to the case of transiting to the third pressing state and the second pressing state. Moreover, in a case of transiting to the releasing state, the photosensor 44 detects an edge opposite to the home position 43*h* of the filler 43, and the cam 42 is rotated by ⅛ rotation until a releasing position, by counting the pulses of the cam motor 50.

When the cam 42 is rotated to the releasing position, that is, when the fourth transition area between the position P6 and the position P7 of the cam 42 contacts to the pressure lever 41, since a load to the pressure lever 41 or the like is reversed, vibration due to backlash may be caused. Thus, it is preferable for a rotation speed in the releasing state to be equal to or less than half regular rotation speed.

As illustrated in FIG. 6, the image forming apparatus 1 includes the main body control part 100, and an operation input part 101. The main body control part 100 includes a micro computer which includes a CPU (Central Processing Unit), a ROM (Read Only Memory), a RAM (Random Access Memory), an I/O interface, and the like. A program being stored beforehand is executed by the CPU. The ROM of the main body control part 100 stores a grammage table defining grammages depending on paper thicknesses.

Also, the main body control part 100 is connected to the cam motor 50, the roller motor 71, the inverter power source 58, a pressuring thermistor 35, the fixing thermopile 34, and the operation input part 101. The main body control part 100 is also connected to each of various sensors and motors which are mounted in the image forming apparatus 1 and are not shown. Moreover, the main body control part 100 controls the roller motor 71, the inverter power source 58, and other various motors based on a detection signal being input from each of various sensors, and also controls the cam motor 50, so as to conduct a pressure process with respect to the fixing part 20.

The operation input part 101 is mounted in a body of the image forming apparatus 1, and includes various keys such as a ten key, a print start key, and the like, and various displays. The operation input part 101 outputs an input signal being input via each of various keys, to the main body control part 100. Moreover, the operation input part 101 is made so that selection information is input to indicate whether or not the sheet member 6*a* is passed through the decurl mechanism 80.

Moreover, the operation input part 101 allows a user to input a print mode. For example, the operation input part 101 is used to input a color print, or a black and white print for the print mode. Also, the operation input part 101 is used to input a high speed print or a low speed print for the print mode. Furthermore, the operation input part 101 is used to selectively input a fixing mode which determines a paper type of the sheet member 6*a* to be supplied as the recording medium. That is, in the first embodiment, the operation input part 101 is made as an information input part.

The fixing mode includes a "non-luster print mode" in which luster is not applied, a "medium luster print mode", and a "excellent luster print mode". It should be noted that in the first embodiment, the "non-luster print mode" and the "medium luster print mode" are not distinguished and are defined as the same mode.

The main body control part 100 outputs a PWM signal for controlling the magnetic flux being output from the induction heating part 30 (FIG. 2) and an ON/OFF control signal of the inverter power source 58.

As described above, the photosensor 44 functions as a home position detection sensor for detecting the home position 43*h* of the filler 43, and includes a laser diode being a light emitting element and a photo diode being a light receiving element.

The pressuring thermistor 35 is arranged to contact to the surface of the pressure roller 23, and measures temperature of the pressure roller 23. The main body control part 100 acquires a signal indicating a surface temperature of the pressure roller 23 from the pressuring thermistor 35, and detects the temperature of the pressure roller 23.

The roller displacement sensor 51 detects a displacement of a distance between shafts of the pair of the conveying rollers 8 in conveying the sheet member 6*a*. The main body control part 100 acquires a signal indicating the displacement of the distance between the shafts of the pair of the conveying rollers 8, from the roller displacement sensor 51, and detects the distance between the shafts of the pair of the conveying rollers 8.

Also, the roller displacement sensor 51 detects the thickness of the sheet member 6*a*. That is, in the first embodiment, the roller displacement sensor 51 is made as a sheet thickness detecting part. It should be note that the thickness of the sheet member 6*a* can be indicated by an input of the user via the operation input part 101.

For example, instead of the roller displacement sensor 51, a device for sending and receiving ultrasound may be arranged to detect ultrasound transmitting through sheet member 6*a*, and a grammage detection sensor or the like may be used to detect a grammage of the sheet member 6*a* based on the detected ultrasound.

In the following, a configuration of the main body control part 100 according to the first embodiment will be described.

The main body control part 100 controls a pressure to apply to the fixing nip part 27 by the pressuring part 40, so that in a case in that the sheet member 6*a* is not passed through the decurl mechanism 80, the pressure is weakened more than a case in that the sheet member 6*a* is passed through the decurl mechanism 80 for correcting a curl of the sheet member 6*a*.

Moreover, the main body control part 100 determines whether or not the sheet member 6*a* is passed through the decurl mechanism 80, based on the selection information input to the operation input part 101. Also, the main body control part 100 determines whether or not the sheet member 6*a* is passed through the decurl mechanism 80, based on the fixing mode input to the operation input part 101.

Furthermore, the main body control part 100 determines whether or not the sheet member 6*a* is passed through the decurl mechanism 80, based on image information scanned by the scan part 2. For example, the main body control part 100 determines that the sheet member 6*a* is not passed through the decurl mechanism 80, when an amount of image information scanned by the scan part 2 is smaller than a predetermined image information amount in a surface ratio. In addition, the main body control part 100 determines whether or not the sheet member 6*a* is passed through the decurl mechanism 80, based on a fixing speed in passing through the fixing nip part 27.

Moreover, in a case in which the detected grammage of the sheet member 6*a* is greater than the predetermined grammage, the main body control part 100 controls a pressure of the fixing nip part 27 to be lower than a case in which the detected grammage of the sheet member 6*a* is equal to or less than the predetermined grammage. The main body control part 100 controls the pressure of the fixing nip part 27 based on the detected thickness of the sheet member 6*a*, without steps.

In addition, the main body control part 100 adjusts the pressure of the fixing nip part 27 to be a pressure of a case in which the sheet member 6*a* is passed through the decurl mechanism 80, after a preparation of a fixing operation is completed or after the fixing operation ends.

Furthermore, the main body control part 100 controls a rotation angle of the cam 42 based on a presence or an absence of a detection of the filler 43 by the photosensor 44. In a case of adjusting the pressure of the fixing nip part 27, after detecting a switch between the presence and the absence of the detection of the filler 43 by the photosensor 44, the main body control part 100 controls the rotation angle of the cam 42. In a case of reducing the pressure of the fixing nip part 27, the main body control part 100 changes the pressure by reducing the rotation speed of the cam 42. In detail, the main body control part 100 controls the rotation speed of the cam 42 to be slower than the regular speed in a range in which the fourth transition area of the cam 42 contacts to the pressure lever 41.

That is, in the first embodiment, the main body control part 100 is made as a control part.

Furthermore, the main body control part 100 determines a paper type of the sheet member 6*a* based on the fixing mode input to the operation input part 101.

Also, the main body control part 100 detects the image information of an unfixed image. That is, in the first embodiment, the main body control part 100 is made as an image information detecting part.

Moreover, the main body control part 100 detects a setting value of the fixing speed at which the sheet member 6*a* is passed through the fixing nip part 27. For example, based on a print sheet which is selected at the operation input part 101, the main body control part 100 detects the setting value of the fixing speed of the selected print sheet. Alternatively, by arranging a speed sensor for detecting a speed to convey the sheet member 6*a* passing through the fixing nip part 27, the main body control part 100 may detect the fixing speed based on a detected value detected by the speed sensor. That is, the main body control part 100 is made as a fixing speed detecting part.

Furthermore, the main body control part 100 detects the grammage of the sheet member 6*a* depending on the thickness of the sheet member 6*a* which is detected by the roller displacement sensor 51, based on the grammage table stored in the ROM. That is, in the first embodiment, the roller displacement sensor 51 and the main body control part 100 are made as a grammage detecting part. It should be noted that the grammage of the sheet member 6*a* may be indicated by an input of the user via the operation input part 101.

In the following, an operation of the fixing device 10 will be described.

When the pressure roller 23 is driven and rotated in the counter clockwise direction in FIG. 2 by a driving motor (not shown), the fixing sleeve 22 is accompanied with the pressure roller 23 in the clockwise direction. In this case, the fixing roller 21 supporting the fixing sleeve 22 is not aggressively driven and rotated. The fixing sleeve 22 as a heat generating member and a fixing member is heated by the magnetic flux generated by the induction heating part 30 at an opposite position to the induction heating part 30.

In detail, 10 kHz through 1 MHz of the high frequency alternating current is applied to the exciting coil 31 from a power source (not shown). 20 kHz through 800 kHz of the high frequency alternating current is preferably applied to the exciting coil 31 from a power source (not shown). In a vicinity of the fixing sleeve 22 opposite to the exciting coil 31, bidirectional magnetic field lines are alternately switched. Since an alternating magnetic field is formed, an eddy current is flowed in the substrate 22*a* of the fixing sleeve 22 being a heat generating layer, and the substrate 22*a* is induced to be heated by an occurrence of Joule heat due to a electrical resistance of the substrate 22*a*. Thus the fixing sleeve 22 is heated by an induction heating of the substrate 22*a* itself.

The surface of the fixing sleeve 22 heated by the induction heating part 30 reaches the fixing nip part 27 in a contact to the pressure roller 23. Then, the toner image T, which is unfixed on the sheet member 6*a* being conveyed, is heated and melted.

In detail, the sheet member 6*a* supporting the toner image T, which is passed through the previously described imaging process, is conveyed and entered between the fixing sleeve 22 and the pressure roller 23 by a guide of the guide plate 24. That is, the sheet member 6*a* is moved in a conveying direction indicated by an arrow Y1 in FIG. 2. Then, the toner image T is fixed on the sheet member 6*a* by heat received from the fixing sleeve 22 and a pressure received from the pressure roller 23. The sheet member 6*a* is separated from the fixing sleeve 22 by the separation plate 25, and is conveyed out from the fixing nip part 27.

After that, the surface of the fixing sleeve 22 passed through the fixing nip part 27 reaches the opposite position to the induction heating part 30, again.

In a case of successively passing papers being of a small size, a relay of the papers is shorted by the main body control part 100, a magnetic field in an opposite direction to the exciting coil 31, a magnetic field in an area arranging the demagnetization coil 33 is reduced, and an occurrence of Joule heat is suppressed at the fixing sleeve 22 in an area where the papers are not passed.

By successively repeating a series of operations described above, a fixing step in an image forming process is completed.

Figure 7:
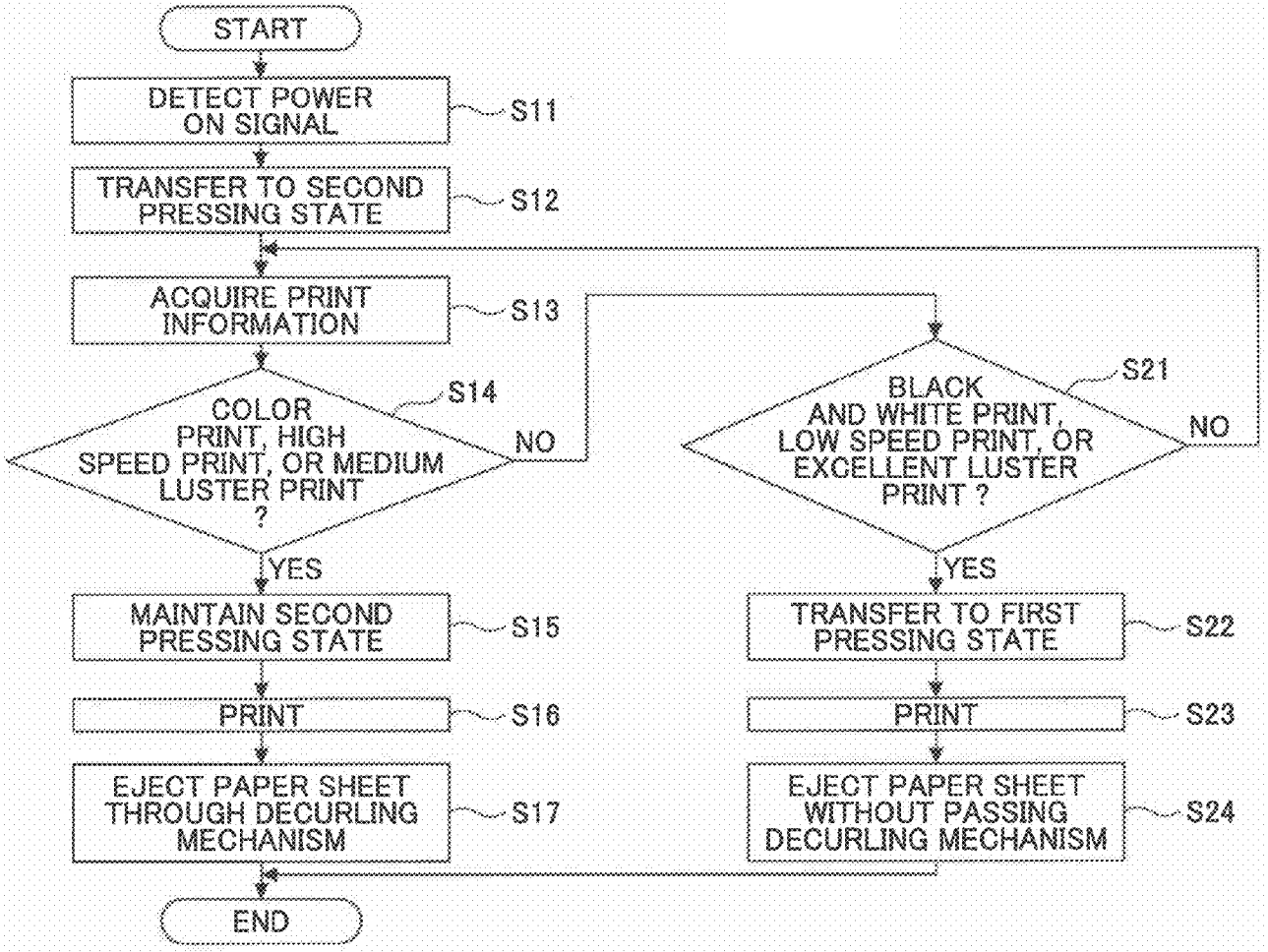
FIG. 7 is a flowchart for explaining a print control process of the image forming apparatus according to the first embodiment of the present invention.

Next, an operation of print control process according to the first embodiment will be described with reference to FIG. 7. A flowchart in FIG. 7 describes contents conducted by a program causing the image forming apparatus 1 to perform the print control process, in which the main body control part 100 executes the program by using the RAM as a working area. Also, the program of the print control process of the image forming apparatus 1 is executed when the main body control part 100 receives an activation signal.

First, the main body control part 100 detects a power ON signal in a dormant state (step S11). In detail, the main body control part 100 determines that the power ON signal is detected, and makes a transition to a power ON state, when the print start key of the operation input part 101 is pressed in the dormant state, when a print indication is input from an external terminal through a network or the like, or when a transmission request of a FAX signal is received from an external facsimile through a telephone line.

Next, the main body control part 100 causes the pressure of the fixing nip part 27 to transfer to the second pressing state (step S12). In detail, the main body control part 100 drives the cam motor 50, rotates the cam 42, and detects the home position 43*h* of the filler 43 by the photosensor 44. Subsequently, the main body control part 100 counts the pulses of the cam motor 50, rotates the cam 42 by ⅜ rotation until a position of the second pressing state, and stops the cam motor 50. In this case, the main body control part 100 turns on the inverter power source 58, and supplies the high frequency alternating current with respect to the exciting coil 31. Thus, the fixing sleeve 22 is heated by an effect of the magnetic flux generated by the exciting coil 31.

Next, the main body control part 100 acquires print information (step S13). In detail, the main body control part 100 acquires the image information scanned by the scan part 2, the print information received through the network or the like, the image information received from the external facsimile through the telephone line, or the like. Also, the main body control part 100 acquires input information if the input information is input from the operation input part 101.

Next, the main body control part 100 determines whether the print mode is for the color print, a high speed print, or the medium luster print from the acquired print information (step S14). The main body control part 100 switches an ejection path based on this determination, and switches to the case in which the sheet member 6*a* is passed through the decurl mechanism 80 or the case in which the sheet member 6*a* is not passed through the decurl mechanism 80.

For example, in a case of the color print, since an image surface ratio is high, a curl amount becomes greater when the sheet member 6*a* is passed through the fixing device 10. In a case of the high speed print or the medium luster print, since the sheet member 6*a* is passed through the fixing nip part 27 at high speed, a temperature difference between the fixing roller 22 and the pressure roller 23 becomes greater, and the curl amount becomes greater when the sheet member 6*a* passes through the fixing device 10. Accordingly, when the curl amount of the sheet member 6*a* becomes greater, the sheet member 6*a* is passed through the decurl mechanism 80 arranged at a paper ejecting port.

Moreover, in a case of the black and white print, since the image surface ratio is small, the curl amount of the sheet member 6*a* passing through the fixing device 10 does not become greater than the case of color print. Also, in a case of the excellent luster print, since the sheet member 6*a* passes through the fixing nip part 27, the temperature difference between the fixing roller 22 and the pressure roller 23 does not become greater. Accordingly, the curl amount of the sheet member 6*a* passing through the fixing device 10 does not become greater than the case of the high speed print or the medium luster print. Thus, in a case in that the curl amount of the sheet member 6*a* is smaller, the sheet member 6*a* is controlled not to pass through the decurl mechanism 80 arranged at the paper ejecting port.

When the main body control part 100 determines that the print mode is for the color print based on the acquired print information, the high speed print or the medium luster print (Yes in step S14), the main body control part 100 maintains the pressure of the fixing nip part 27 in the second pressing state (step S15). In a case in which it is determined that the print mode is the color print, the high speed print, or the medium luster print, since the sheet member 6*a* is passed through the decurl mechanism 80, there is no problem even if the curl amount becomes greater when the sheet member 6*a* passes through the fixing device 10. Accordingly, it is possible to control a pressing level to be higher and to improve fixing the toner image T by the higher pressing level.

Subsequently, the main body control part 100 conveys the sheet member 6*a* by driving the roller motor 71, and conducts printing an image by transferring the toner image T by the transfer roller 9 and by fixing the toner image T by the fixing device 10 (step S16). Next, the main body control part 100 drives the roller motor 71, conveys the sheet member 6*a* to pass through the decurl mechanism 80, and ejects the sheet member 6*a* (step S17).

On the other hand, when it is determined that the print mode is not for the color print, the high speed print, and the medium luster print based on the acquired print information (No in the step S14), the main body control part 100 determines whether the print mode is for the black and white print, the low speed prints, or the excellent luster print based on the acquired print information (step S21). When it is determined that the print mode is for the black and white print, the low speed prints, and the excellent luster print based on the acquired print information (No in the step S21), the main body control part 100 goes back to the step S13, and acquires next print information.

When it is determined that the print mode is for the black and white print, the low speed print, or the excellent luster print based on the acquired print information (Yes in the step S21), the main body control part 100 makes a transition for the pressure of the fixing nip part 27 to the first pressing state (step S22). In detail, the main body control part 100 drives the cam motor 50, rotates the cam 42, and detects the home position 43*h* of the filler 43 by the photosensor 44. Subsequently, the main body control part 100 counts the pulse of the cam motor 50, rotates the cam 42 by ⅛ rotation until a position of the first pressing state, and stops the cam motor 50.

When the print mode is for the black and white print, the low speed print, or the excellent luster print, the sheet member 6*a* is not passed through the decurl mechanism 80. If the curl amount of the sheet member 6*a* passing through the fixing device 10 becomes greater, the sheet member 6*a* is ejected in maintaining the greater curl amount. Thus, the curl amount of the sheet member 6*a* is reduced by reducing the pressing level.

Next, the main body control part 100 conveys the sheet member 6*a* by driving the roller motor 71, and conducts printing an image by transferring the toner image T by the transfer roller 9 and by fixing the toner image by the fixing device 10 (step S23). Next, the main body control part 100 drives the roller motor 71, conveys the sheet member 6*a* without passing through the decurl mechanism 80, and ejects the sheet member 6*a* (step S24).

The main body control part 100 repeats the above-described process every time a print request is received.

It should be noted that it is not limited to two pressing states in the fixing nip part 27. Alternatively, more than two stages may be set. In the above, since the two pressing states are applied to the fixing nip part 27, instead of providing the third pressing area, the cam 42 is provided with the releasing area, the first pressing area, and the second pressing area.

[Second Embodiment]

Figure 8:
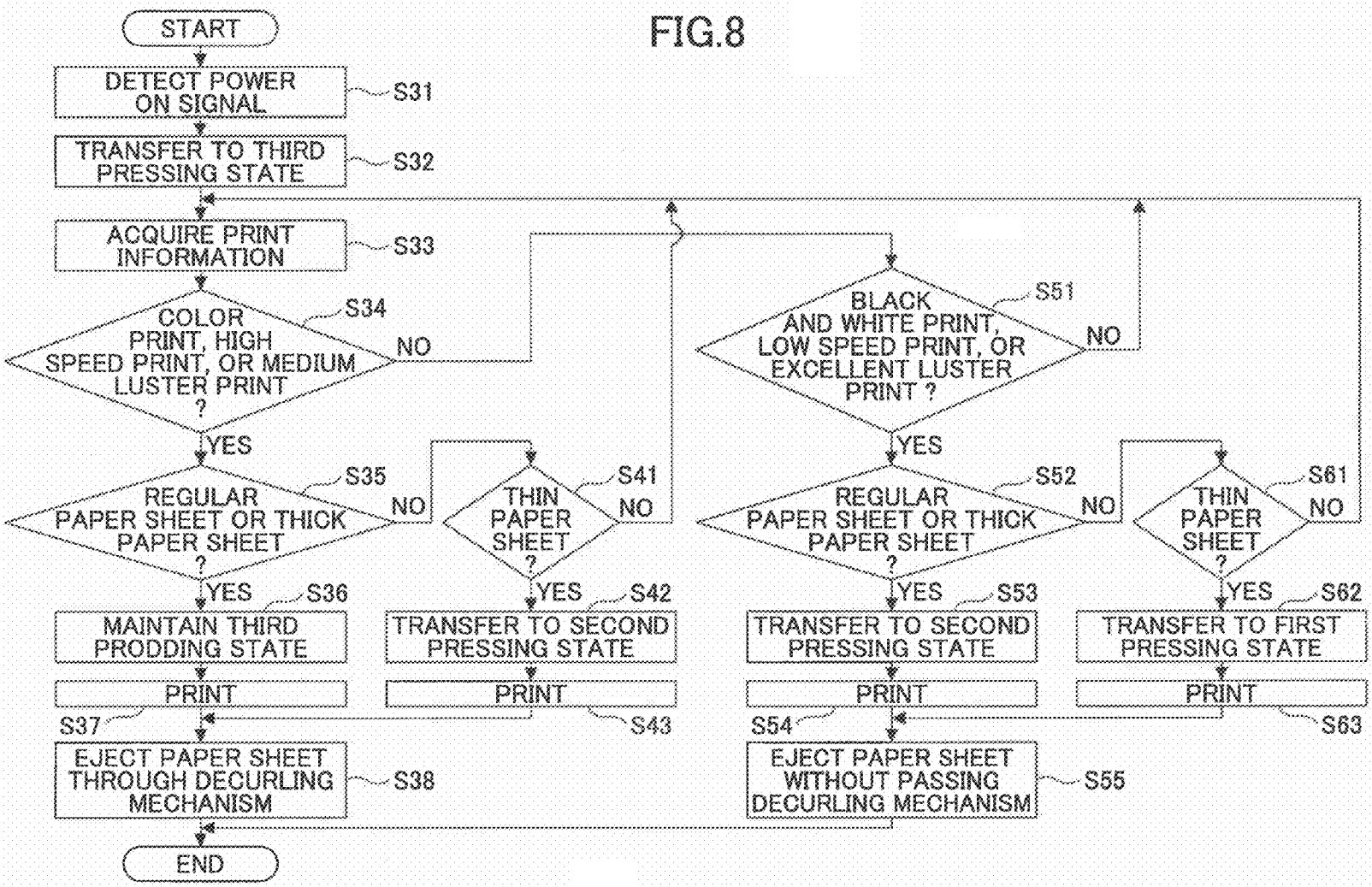
FIG. 8 is a flowchart for explaining a print control process of the image forming apparatus according to a second embodiment of the present invention.

In the following, an image forming apparatus according to the second embodiment will be described with reference to FIG. 8.

A configuration of the image forming apparatus according to the second embodiment is approximately the same as that of the image forming apparatus 1 according to the first embodiment. Each of elements is described with the same reference numerals in the first embodiment illustrated in FIG. 1 through FIG. 6, and the image forming apparatus in the second embodiment is described as the image forming apparatus 1. Only different parts will be explained in detail.

The main body control part 100 according to the second embodiment switches a pressure amount depending on the thickness of a print sheet (sheet member 6*a*). In detail, the main body control part 100 switches a pressing level between a case in which the print sheet is a regular paper sheet or a thick paper sheet and a case in which the print sheet is a thin paper sheet. In the case of the regular paper sheet and the thick paper sheet, a capability of fixing an image is concerned more than the curl amount of the print sheet. Thus, the pressing level is set to be higher. In the case of the thin paper sheet, the curl amount of the print sheet is concerned more than the capability of fixing the image. Thus, the pressing level is set to be lower.

Next, referring to FIG. 8, an operation of a print control process according to the second embodiment will be described. A flowchart in FIG. 8 describes contents conducted by a program causing the image forming apparatus 1 to perform the print control process, in which the main body control part 100 executes the program by using the RAM as a working area. Also, the program of the print control process of the image forming apparatus 1 is executed when the main body control part 100 receives an activation signal.

FIG. 9 illustrates a correspondence table for the pressing level to be selected based on the print mode and the thickness of the print sheet.

First, the main body control part 100 detects a power ON signal in a dormant state (step S31). In detail, the main body control part 100 determines that the power ON signal is detected, and makes a transition to a power ON state, when the print start key of the operation input part 101 is pressed in the dormant state, when a print indication is input from an external terminal through a network or the like, or when a transmission request of a FAX signal is received from an external facsimile through a telephone line.

Next, the main body control part 100 causes the pressure of the fixing nip part 27 to transfer to the third pressing state (step S32). In detail, the main body control part 100 drives the cam motor 50, rotates the cam 42, and detects the home position 43*h* of the filler 43 by the photosensor 44. Subsequently, the main body control part 100 counts the pulse of the cam motor 50, rotates the cam 42 by ⅝ rotation until a position of the third pressing state, and stops the cam motor 50. In this case, the main body control part 100 turns on the inverter power source 58, and supplies the high frequency alternating current with respect to the exciting coil 31. Thus, the fixing sleeve 22 is heated by an effect of the magnetic flux generated by the exciting coil 31.

Next, the main body control part 100 acquires print information (step S33). In detail, the main body control part 100 acquires the image information scanned by the scan part 2, the print information received through the network or the like, the image information received from the external facsimile through the telephone line, or the like. Also, the main body control part 100 acquires input information if the input information is input from the operation input part 101.

Next, the main body control part 100 determines whether the print mode is for the color print, a high speed print, or the medium luster print from the acquired print information (step S34). The main body control part 100 switches an ejection path based on this determination, and switches to the case in which the sheet member 6*a* is passed through the decurl mechanism 80 or the case in which the sheet member 6*a* is not passed through the decurl mechanism 80.

When the main body control part 100 determines that the print mode is for the color print based on the acquired print information, the high speed print or the medium luster print (Yes in step S34), the main body control part 100 determines whether the sheet member 6*a* is the regular paper sheet or the thick paper sheet (step S35).

When it is determined that the sheet member 6*a* is the regular paper sheet or the thick paper sheet based the acquired print information or a detection result of the roller displacement sensor 51 (Yes in the step S35), the main body control part 100 maintains the pressure of the fixing nip part 27 (step S36).

Subsequently, the main body control part 100 conveys the sheet member 6*a* by driving the roller motor 71, and conducts printing of an image by transferring the toner image T by the transfer roller 9 and by fixing the toner image T by using the fixing device 10 (step S37). Next, the main body control part 100 drives the roller motor 71, conveys the sheet member 6*a* to pass through the decurl mechanism 80, and ejects the sheet member 6*a* (step S38).

On the other hand, when it is determined that the sheet member 6*a* is not the regular paper sheet and the thick paper sheet (No in the step S35), the main body control part 100 determines whether or not the sheet member 6*a* is the thin paper sheet (step S41). When it is determined that the sheet member 6*a* is the thin paper sheet (No in the step S41), the main body control part 100 goes back to the step S33, and acquires next print information.

When it is determined that the sheet member 6*a* is the thin paper sheet (Yes in the step S41), the main body control part 100 causes the pressure of the fixing nip part 27 to transfer to the second pressing state (step S42). In detail, the main body control part 100 drives the cam motor 50, rotates the cam 42, and detects the home position 43*h* of the filler 43 by the photosensor 44. Subsequently, the main body control part 100 counts the pulses of the cam motor 50, rotates the cam 42 by ⅜ rotation until a position of the second pressing state, and stops the cam motor 50.

Subsequently, the main body control part 100 conveys the sheet member 6*a* by driving the roller motor 71, and conducts printing of an image by transferring the toner image T by the transfer roller 9 and by fixing the toner image T by the fixing device 10 (step S43). Next, the main body control part 100 drives the roller motor 71, conveys the sheet member 6*a* to pass through the decurl mechanism 80, and ejects the sheet member 6*a* (step S38).

On the other hand, if it is determined that the print mode is not the color print, the high speed print, and the medium luster print based on the acquired print information (No in the step 34), the main body control part 100 determines whether the print mode is the black and white print, the low speed print, or the excellent luster print based on the acquired print information (step S51). When it is determined that the print mode is the black and white print, the low speed print, and the excellent luster print based on the acquired print information (No in the step S51), the main body control part 100 goes back to the step S33, and acquires next print information.

When it is determined that the print mode is the black and white print, the low speed print, or the excellent luster print based on the acquired print information (Yes in the step S51), the main body control part 10 determines whether the sheet member 6*a* is the regular paper sheet or the thick paper sheet (step S52).

When it is determined that the sheet member 6*a* is the regular paper sheet or the thick paper sheet based the acquired print information or a detection result of the roller displacement sensor 51 (Yes in the step S52), the main body control part 100 causes the pressure of the fixing nip part 27 to transfer to the second pressure state (step S53). In detail, the main body control part 100 drives the cam motor 50, rotates the cam 42, and detects the home position 43*h* of the filler 43 by the photosensor 44. Subsequently, the main body control part 100 counts the pulses of the cam motor 50, rotates the cam 42 by ⅜ rotation until a position of the second pressing state, and stops the cam motor 50.

Subsequently, the main body control part 100 conveys the sheet member 6*a* by driving the roller motor 71, and conducts printing of an image by transferring the toner image T by the transfer roller 9 and by fixing the toner image T by the fixing device 10 (step S54). Next, the main body control part 100 drives the roller motor 71, conveys the sheet member 6*a* without passing through the decurl mechanism 80, and ejects the sheet member 6*a* (step S55).

On the other hand, when it is determined that the sheet member 6*a* is not the regular paper sheet and the thick paper sheet (No in the step S52), the main body control part 100 determines whether or not the print sheet is the thin paper sheet (step S61). When it is determined that the sheet member 6*a* is not the thin paper sheet (No in the step S61), the main body control part 100 goes back to step S33, and acquires next print information.

When it is determined that the sheet member 6*a* is the thin paper sheet (Yes in the step S61), the main body control part 100 causes the pressure of the fixing nip part 27 to transfer to the first pressing state (step S62). In detail, the main body control part 100 drives the cam motor 50, rotates the cam 42, and detects the home position 43*h* of the filler 43 by the photosensor 44. Subsequently, the main body control part 100 counts the pulses of the cam motor 50, rotates the cam 42 by ⅛ rotation until a position of the first pressing state, and stops the cam motor 50.

Subsequently, the main body control part 100 conveys the sheet member 6*a* by driving the roller motor 71, and conducts printing of an image by transferring the toner image T by the transfer roller 9 and by fixing the toner image T by the fixing device 10 (step S63). Next, the main body control part 100 drives the roller motor 71, conveys the sheet member 6*a* without passing through the decurl mechanism 80, and ejects the sheet member 6*a* (step S55).

The main body control part 100 repeats the above-described process every time a print request is received.

As described above, in a case in which the sheet member 6*a* is not passed through the decurl mechanism 80, the image forming apparatus 1 controls the pressure to apply to the fixing nip part 27, to be lower than a case in which the sheet member 6*a* is passed through the decurl mechanism 80. Therefore, even in a case in which the curl of the sheet member 6*a* is not corrected by the decurl mechanism 80, it is possible to suppress the curl of the sheet member 6*a* and to prevent an occurrence of a jam.

Moreover, in the image forming apparatus 1 according to the present invention, the selection information, which indicates whether or not the sheet member 6*a* is passed through the decurl mechanism 80, is input via the operation input part 101. Based on the selection information, it is possible to properly determine whether or not the sheet member 6*a* is passed through the decurl mechanism 80, to suppress the curl of the sheet member 6*a*, and to prevent an occurrence of a jam.

Furthermore, in the image forming apparatus 1 according to the present invention, the fixing mode is input via the operation input part 101 to determine a paper type of the sheet member 6*a*. Based on the fixing mode, it is possible to properly determine whether or not the sheet member is passed through the decurl mechanism 80, to suppress the curl of the sheet member 6*a*, and to prevent an occurrence of a jam.

Moreover, the main body control part 100 according to the present invention detects the image information of the unfixed image. Based on the image information of the unfixed image, it is possible to properly determine whether or not the sheet member 6*a* is passed through the decurl mechanism 80, to suppress the curl of the sheet member 6*a*, and to prevent the occurrence of a jam.

Furthermore, the main body control part 100 according to the present invention detects the setting value of the fixing speed at which the sheet member 6*a* is passed through the fixing nip part 27. Based on the detected fixing speed, it is possible to properly determine whether or not the sheet member 6*a* is passed through the decurl mechanism 80, to suppress the curl of the sheet member 6*a*, and to prevent the occurrence of a jam.

Moreover, in a case in which the grammage of the sheet member 6*a* is greater than the predetermined grammage, the main body control part 100 according to the present invention controls the pressure of the fixing nip part 27 to be lower than a case in which the grammage of the sheet member 6*a* is equal to or less than the predetermined grammage. Accordingly, at a portion where the edge of the sheet member 6*a* passes, it is possible to reduce a load to surface members of and the fixing sleeve 22 and the pressure roller 23, to suppress the curl of the sheet member 6*a*, and to prevent the occurrence of a jam.

Furthermore, the main body control part 100 according to the present invention controls the pressure of the fixing nip part 27 based on the thickness of the sheet member 6*a*. At the portion where the edge of the sheet member 6*a* passes, it is possible to reduce a load to surface members of and the fixing sleeve 22 and the pressure roller 23, to properly adjust the pressure of the fixing nip part 27, to suppress the curl of the sheet member 6*a*, and to prevent the occurrence of a jam.

Moreover, the main body control part 100 according to the present invention applies the pressure to the fixing nip part 27 which is formed by the substrate 22*a* of the fixing sleeve 22, and the pressure roller 23, by properly controlling the pressure applied to the fixing nip part 27. Even in a case of using the substrate 22*a* of the heat generating layer which does not have high durability, it is possible to suppress an adverse affect due to the pressure, to suppress the curl of the sheet member 6*a*, and to prevent the occurrence of a jam.

Furthermore, even in a case in which the pressure of the fixing nip part 27 is controlled to be lower, the image forming apparatus 1 according to the present invention controls a heating amount greater than a case in which the pressure is not controlled to be lower. In a case in which the pressure of the fixing nip part 27 becomes lower, deterioration of fixing the image is concerned more than a case in which the pressure is stronger. However, by controlling the heating amount greater than the case in which the pressure is not controlled to be lower, it is possible to prevent the deterioration of fixing the image.

Moreover, the image forming apparatus 1 according to the present invention adjusts the pressure to be a pressure for a case in which the sheet member 6*a* is passed through the decurl mechanism 80 which is generally used at high frequency. Therefore, when a print job is received, the pressure is less frequently adjusted, and it is possible to reduce time until a print is completed.

Furthermore, in the image forming apparatus 1 according to the present invention, the pressuring part 40 includes the cam 42 for changing the pressure of the fixing nip part 27, the filler 43 for rotating by associating with the cam 42, and the photosensor 44 for detecting the filler 43. The main body control part 100 controls the rotation angle of the cam 42 based on the presence or the absence of detecting the filler 43 by the photosensor 44. Therefore, it is possible to simplify a configuration of the pressuring part 40, and to easily control a pressure.

Moreover, in a case of changing the pressure of the fixing nip part 27, the image forming apparatus 1 according to the present invention controls the rotation angle of the cam 42 after detecting a switch between the presence and the absence of detecting the filler 43 by the photosensor 44. Thus, an error of the rotation angle is solved every time the pressure is changed, and the pressure can be precisely controlled. Therefore, it is possible to suppress the curl of the sheet member 6*a*, and to prevent the occurrence of a jam.

Furthermore, in a case of reducing the pressure of the fixing nip part 27, the image forming apparatus 1 according to the present invention changes the pressure by reducing the rotation speed of the cam 42. Therefore, it is possible to prevent a rapid reverse in a loading direction, and to prevent vibration and shock to each part.

Moreover, in the image forming apparatus 1 according to the present invention, the cam 42 has the first pressing area 42*b*, the second pressing area 42*c*, the third pressing area 42*d*, and the releasing area 42*e*, in response to the pressure stages, and also has the first transition area 49*a*, the second transition area 49*b*, the third transition area 49*c*, and the fourth transition area 49*d*. By providing the statary sections, it is possible to improve accuracy of the pressure of the fixing nip part 27 even if the cam 42 is not precisely positioned. In addition, by providing the curve sections for switching the pressure, it is possible to suppress an initial torque when the pressure of the fixing nip part 27 is changed.

As described above, in the fixing device and the image forming apparatus according to the present invention, the curl of the recording medium can be suppressed and the occurrence of a jam can be suppressed. These effects can be useful for the fixing device for fixing the unfixed image to the recording medium, the image forming apparatus such as a copier, a facsimile, a printer, a printing machine, and the like including the fixing device, or the like.

The present invention is not limited to the specifically disclosed embodiments, and variations and modifications may be made without departing from the scope of the invention.

The present application is based on the Japanese Priority Patent Application No. 2010-007165 filed on Jan. 15, 2010, the entire contents of which are hereby incorporated by reference.

What is claimed is:

1. A fixing device comprising:

a fixing rotative body;

a pressuring rotative body configured to form a fixing nip part between the pressuring rotative body and the fixing rotative body by contacting the fixing rotative body;

a heating part configured to heat at least one of the fixing rotative body and the pressuring rotative body;

a pressing part configured to apply a pressure to the fixing nip part; and a control part configured to control the pressure to be applied to the fixing nip part by the pressing part, to be lower than a case in which a recording medium passes through a curl correcting part for correcting a curl of the recording medium, when the recording medium does not pass through the curl correcting part, wherein an unfixed image carried by the recording medium is passed through the fixing nip part being pressed by the fixing rotative body and the pressuring rotative body, and is fixed to the recording medium.

2. The fixing device as claimed in claim 1, further comprising:

an information input part configured to input selection information indicating whether or not the recording medium passes through the curl correcting part, wherein said control part determines whether or not the recording medium passes through the curl correcting part based on the selection information input to the information input part.

3. The fixing device as claimed in claim 2, wherein said information input part inputs a fixing mode for determining a paper type of the recording medium as the selection information, and said control part determines whether or not the recording medium passes through the curl correcting part based on the fixing mode input to the information input part.

4. The fixing device as claimed in claim 1, further comprising an image information detecting part configured to detect image information of the unfixed image, wherein said control part determines whether or not the recording medium passes through the curl correcting part based on the image information detected by said image information detecting part.

5. The fixing device as claimed in claim 1, further comprising a fixing speed detecting part configured to detect a setting value of a fixing speed at which the recording medium passes through the fixing nip part, wherein said control part determines whether or not the recording medium passes through the curl correcting part based on the fixing speed detected by said fixing speed detecting part.

6. The fixing device as claimed in claim 1, further comprising a grammage detecting part configured to detect a grammage of the recording medium, wherein said control part controls the pressure of the fixing nip part to be lower than a case in which the grammage of the recording medium detected by said grammage detecting part is equal to or less than a predetermined grammage, when the grammage of the recording medium is greater than the predetermined grammage.

7. The fixing device as claimed in claim 1, further comprising a sheet thickness detecting part configured to detect a sheet thickness of the recording medium, wherein said control part controls the pressure of the fixing nip part based on the sheet thickness of the recording medium detected by said sheet thickness detecting part, without steps.

8. The fixing device as claimed in claim 1, wherein said fixing rotative body includes a heat generating layer for generating heat by electromagnetic induction, and said heating part generates a magnetic flux so that the heat generating layer of the fixing rotative body generates heat due to electromagnetic induction.

9. The fixing device as claimed in claim 1, wherein said heating part generates a heating amount greater than the case in which the pressure is not controlled to be lower, when the control part controls the pressure of the fixing nip part to be lower.

10. The fixing device as claimed in claim 1, wherein said control part adjusts the pressure to be a pressure of a case of passing through the curl correcting part, after a preparation of a fixing operation is completed or after a fixing operation ends.

11. The fixing device as claimed in claim 1, wherein said pressuring part includes a cam for changing the pressure of the fixing nip part by pressing the pressure rotative body, a filler which has a cut-off and rotates in association with the cam, and a photosensor for detecting the filler, wherein said control part controls a rotation angle of the cam based on a presence or an absence of detecting the filler by the photosensor.

12. The fixing device as claimed in claim 11, wherein said control part controls the rotation angle of the cam after detecting a switch between the presence and the absence of detecting the filler by the photosensor, when changing the pressure of the fixing nip part.

13. The fixing device as claimed in claim 11, wherein said control part controls rotation directions of the cam to be one direction, so that the pressure is changed by reducing a rotation speed of the cam in a case of reducing the pressure of the fixing nip part.

14. The fixing device as claimed in claim 11, wherein said cam includes statary sections in response to pressure stages, and curve sections for switching a pressure amount.

15. An image forming apparatus including a fixing device comprising:

a fixing rotative body;

a pressuring rotative body configured to form a fixing nip part between the pressuring rotative body and the fixing rotative body by contacting the fixing rotative body;

a heating part configured to heat at least one of the fixing rotative body and the pressuring rotative body;

a pressing part configured to apply a pressure to the fixing nip part; and a control part configured to control the pressure to be applied to the fixing nip part by the pressing part, to be lower than a case in which a recording medium passes through a curl correcting part for correcting a curl of the recording medium, when the recording medium does not pass through the curl correcting part, wherein an unfixed image carried by the recording medium is passed through the fixing nip part being pressed by the fixing rotative body and the pressuring rotative body, and is fixed to the recording medium.

* * * * *